US009908758B2

(12) United States Patent
Crymble et al.

(10) Patent No.: US 9,908,758 B2
(45) Date of Patent: Mar. 6, 2018

(54) UPSTART MOTORCYCLE JACK SYSTEM

(71) Applicant: Seraphim Enterprises, Inc., North Vancouver (CA)

(72) Inventors: Derek M. Crymble, West Vancouver (CA); Jason Elsworth, North Vancouver (CA)

(73) Assignee: SERAPHIM ENTERPRISES, INC., North Vancouver (CA)

( * ) Notice: Subject to any disclaimer, the term of this patent is extended or adjusted under 35 U.S.C. 154(b) by 58 days.

(21) Appl. No.: 15/086,843

(22) Filed: Mar. 31, 2016

(65) Prior Publication Data

US 2017/0283225 A1 Oct. 5, 2017

(51) Int. Cl.

| | |
|---|---|
| ***B66F 3/12*** | (2006.01) |
| ***B66F 7/28*** | (2006.01) |
| ***B66F 7/22*** | (2006.01) |
| ***B66F 3/22*** | (2006.01) |

(52) U.S. Cl.

CPC ..... *B66F 3/12* (2013.01); *B66F 3/22* (2013.01); *B66F 7/22* (2013.01); *B66F 7/28* (2013.01)

(58) Field of Classification Search

CPC . B25J 15/0475; B66F 11/042; B66F 2700/12; B66F 2700/123; B66F 2700/126; B66F 3/12; B66F 3/22; B66F 7/10; B66F 7/14; B66F 7/18; B66F 7/22; B66F 7/26; B66F 7/28; B66F 9/07559

See application file for complete search history.

(56) References Cited

U.S. PATENT DOCUMENTS

| | | | | |
|---|---|---|---|---|
| 3,317,187 A * | 5/1967 | Steppon | B21D 53/84 | 254/126 |
| 4,723,756 A * | 2/1988 | Stumpf, Jr. | B66F 7/18 | 254/134 |
| 5,215,287 A * | 6/1993 | Leski | B66F 3/22 | 254/122 |
| 5,588,639 A * | 12/1996 | Holman | B66F 5/04 | 254/133 R |
| 5,769,397 A * | 6/1998 | Dhein | B66F 5/04 | 254/134 |
| 6,119,989 A * | 9/2000 | Hollington | A47B 13/02 | 248/170 |
| 6,168,138 B1 * | 1/2001 | Dhein | B25H 1/0014 | 254/134 |
| 2011/0001098 A1 * | 1/2011 | Lee | B66F 3/12 | 254/126 |

* cited by examiner

*Primary Examiner* — Joseph J Hail
*Assistant Examiner* — Tyrone V Hall, Jr.

(57) ABSTRACT

An upstart motorcycle jack system that lifts a motorcycle from laying on its side to an upright position includes a scissor jack, a foot, a fulcrum pin, a mounting adaptor, and a motorcycle lift bracket. The motorcycle lift bracket is integrated onto the motorcycle. The foot is hingedly connected to a base pad of the scissor jack. The scissor jack pivotably mounts to the motorcycle lift bracket through the mounting adaptor and the fulcrum pin to initiate the lifting process. The mechanical leverage for the lifting process is provided by the scissor jack to lift the dead weight of the motorcycle pass a 45-degree angle. The scissor jack also transfers some of the motorcycle weight to the foot when the base pad starts to tilt toward the motorcycle. Once the scissor jack is fully extended, a rider can easily push the motorcycle back into the upright position.

19 Claims, 9 Drawing Sheets

UPSTART MOTORCYCLE JACK SYSTEM

FIELD OF THE INVENTION

The present invention relates generally to systems of raising and lifting heavy objects. More specifically, the present invention is an upstart motorcycle jack system that allows a single person to comfortably lift a dropped motorcycle.

BACKGROUND OF THE INVENTION

A typical motorcycle can weight 550-pounds or more. Lifting a fallen motorcycle off the ground is nearly impossible for most riders and can be dangerous for the rider due to the weight of the motorcycle, particularly if the rider is already injured, winded, etc. from the initial downing of the motorcycle. For example, if the rider loses the grip of the motorcycle during the lifting process, the motorcycle may fall again consequently hurting the rider and/or further damaging the motorcycle. Even if the rider is able to lift the motorcycle, the rider can physically get hurt due to the weight of the motorcycle. Riders currently use different techniques to lift fallen motorcycle. For example, riders rest their butt/lower back against the fallen motorcycle and grab the motorcycle with both hands. Then the leg muscles are utilized to slowly lean the motorcycle into the side-stand. Other than the specialized techniques, the motorcycle industry lacks a proper lift system or a jack system for the dropped motorcycle.

It is therefore an object of the present invention to provide an upstart motorcycle jack system that aids the rider to comfortably lift a fallen motorcycle. More specifically, a scissor lift mechanism of the present invention allows the rider to lift the motorcycle past a 45-degree arc angle so that the weight of the motorcycle can be transferred on the wheels of the motorcycle. The scissor lifting mechanism securely rests against the ground floor and functions as a fulcrum member with the motorcycle. As a result, the rider is then able to push the motorcycle into the side-stand such that a fraction of the lift force is required to push the motorcycle to achieve 90-degree side stand.

DETAIL DESCRIPTIONS OF THE INVENTION

All illustrations of the drawings are for the purpose of describing selected versions of the present invention and are not intended to limit the scope of the present invention.

Figure 1:
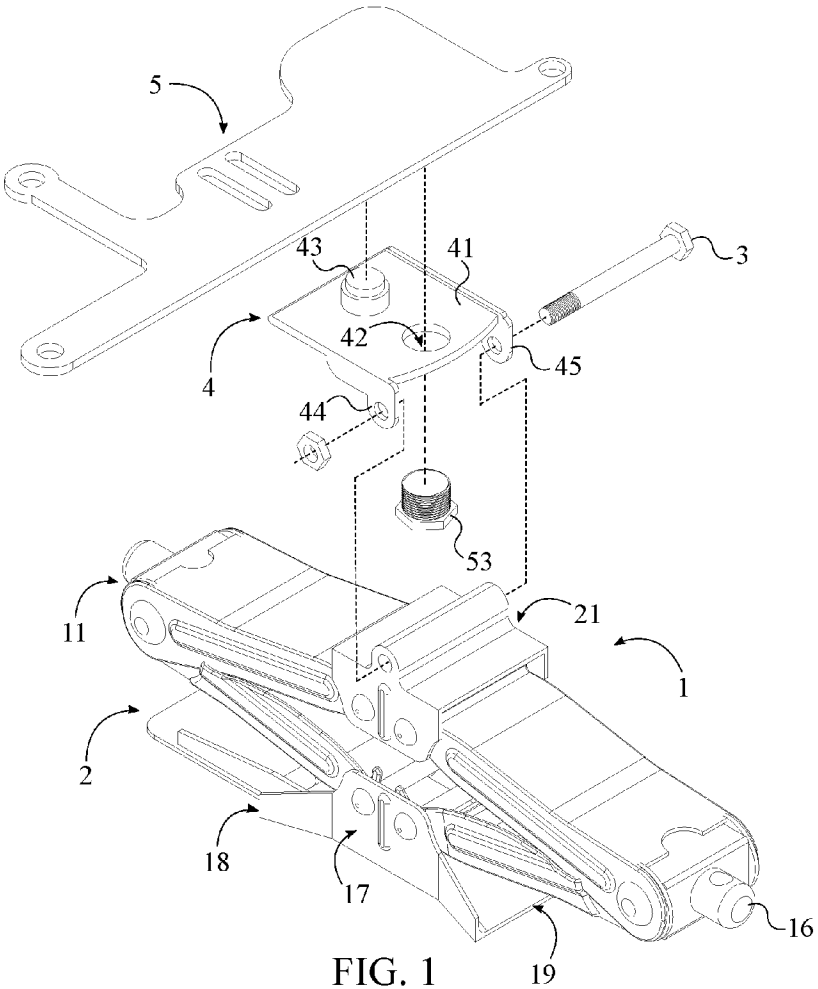
FIG. 1 is a perspective exploded view of the present invention.

The present invention is an upstart motorcycle jack system that allows a rider to easily lift a motorcycle from laying on its side to an upright position. The present invention enables the rider to utilize mechanical leverage as the initial lift force required so that the rider can easily push the motorcycle back into the upright position. The present invention comprises a scissor jack 1, a foot 2, a fulcrum pin 3, a mounting adaptor 4, and a motorcycle lift bracket 5. The scissor jack 1 provides the mechanical leverage within the present invention and comprises a lifting mechanism 11, a base pad 17, and a sleeve bracket 21. In reference to FIG. 1 that illustrates the general configuration of the present invention, the base pad 17 is mounted to the lifting mechanism 11 so that the scissor jack 1 is able to rest against the ground floor. The sleeve bracket 21 is also mounted to the lifting mechanism 11. However, the sleeve bracket 21 is positioned opposite of the base pad 17 and across the lifting mechanism 11. The motorcycle lift bracket 5 is integrated onto the motorcycle and provides necessary surface area for the scissor jack 1 to be attached. More specifically, the mounting adaptor 4 is removably mounted to the motorcycle lift bracket 5 so that the sleeve bracket 21 can be pivotably attached to the mounting adaptor 4 with the fulcrum pin 3. In order to properly lift the motorcycle and to prevent unnecessary movements of the scissor jack 1, the foot 2 is hingedly connected to a first end 18 of the base pad 17. As a result, the present invention is able to transfer some of the motorcycle weight from the scissor jack 1 to the foot 2 during the lifting process of the motorcycle.

Figure 2:
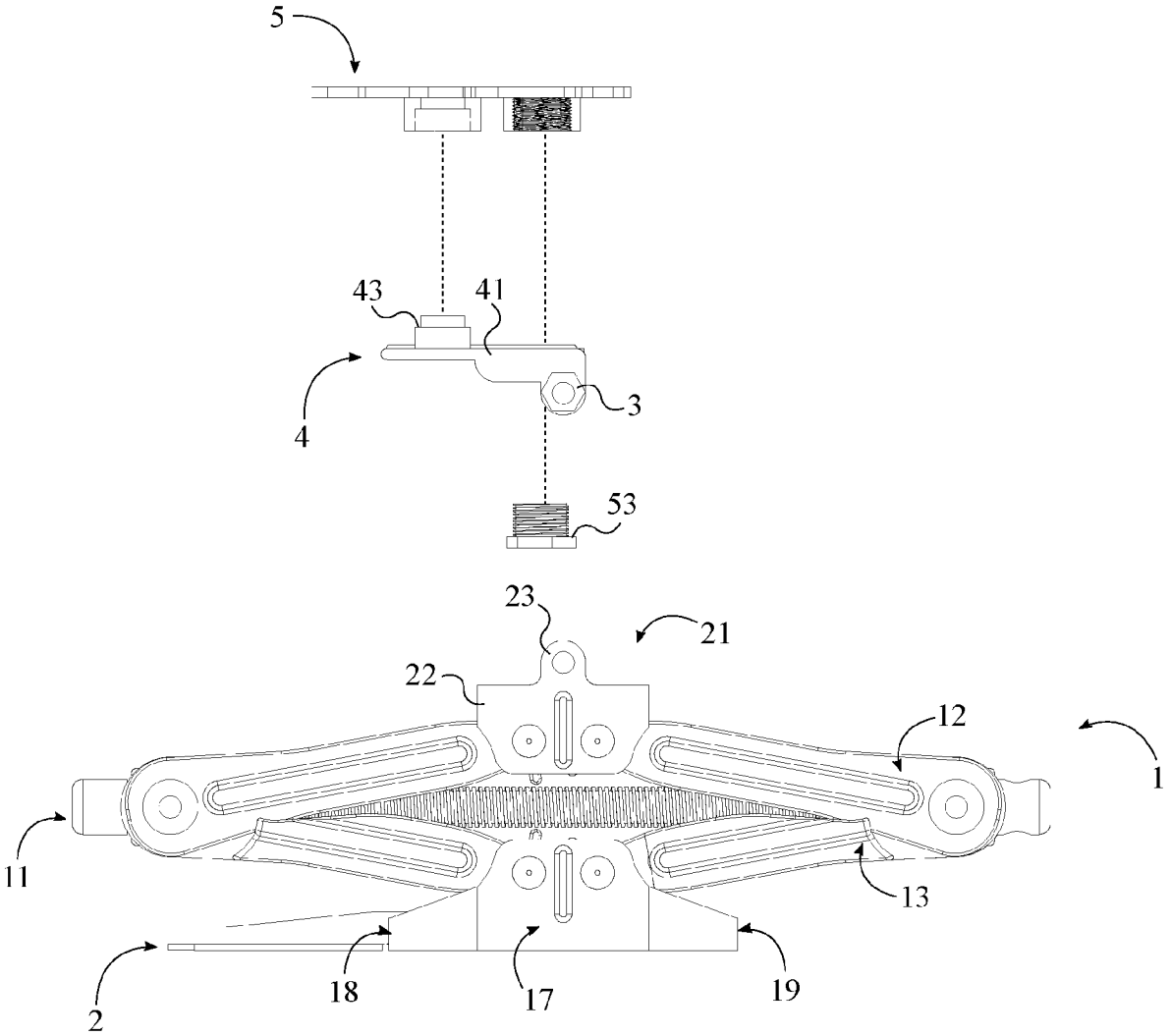
FIG. 2 is a side exploded view of the present invention.

The lifting mechanism 11 provides the mechanical leverage within the scissor jack 1 and comprises an upper arm assembly 12, a lower arm assembly 13, a drive trunnion 14, a stationary trunnion 15, and a threaded spindle 16. The upper arm assembly 12 and the lower arm assembly 13 conjunctionally provide the vertical lift within the lifting mechanism 11. The sleeve bracket 21 can axially move upward and away from the base pad 17 as the base pad 17 is diametrically opposed of the sleeve bracket 21. The base pad 17 evenly distributes the motorcycle weight absorbed by the scissor jack 1 and functions as the primary foundation of the present invention. In reference to FIG. 2, the base pad 17 is mounted to the lower arm assembly 13, and the sleeve bracket 21 is mounted to the upper arm assembly 12. The lower arm assembly 13 and the upper arm assembly 12 are coaxially mounted to each other by the stationary trunnion 15 and the drive trunnion 14. The drive trunnion 14 is adjacently positioned with the first end 18 of the base pad 17, and the stationary trunnion 15 is adjacently positioned with a second end 19 of the base pad 17 to complete the proper configuration for the lifting mechanism 11. More specifically, the threaded spindle 16 is engaged with the stationary trunnion 15 and the drive trunnion 14 so that the drive trunnion 14 can be pulled toward the stationary trunnion 15 during the lifting process of the motorcycle. The threaded spindle 16 can be powered through means of external powers, such as hydraulic power systems, electrical power systems, pneumatic power system, and human power. In order words, the rotation of the threaded spindle 16 retracts the drive trunnion 14 toward the stationary trunnion 15 so that the sleeve bracket 21 can vertically move upward and away from the base pad 17.

Figure 3:
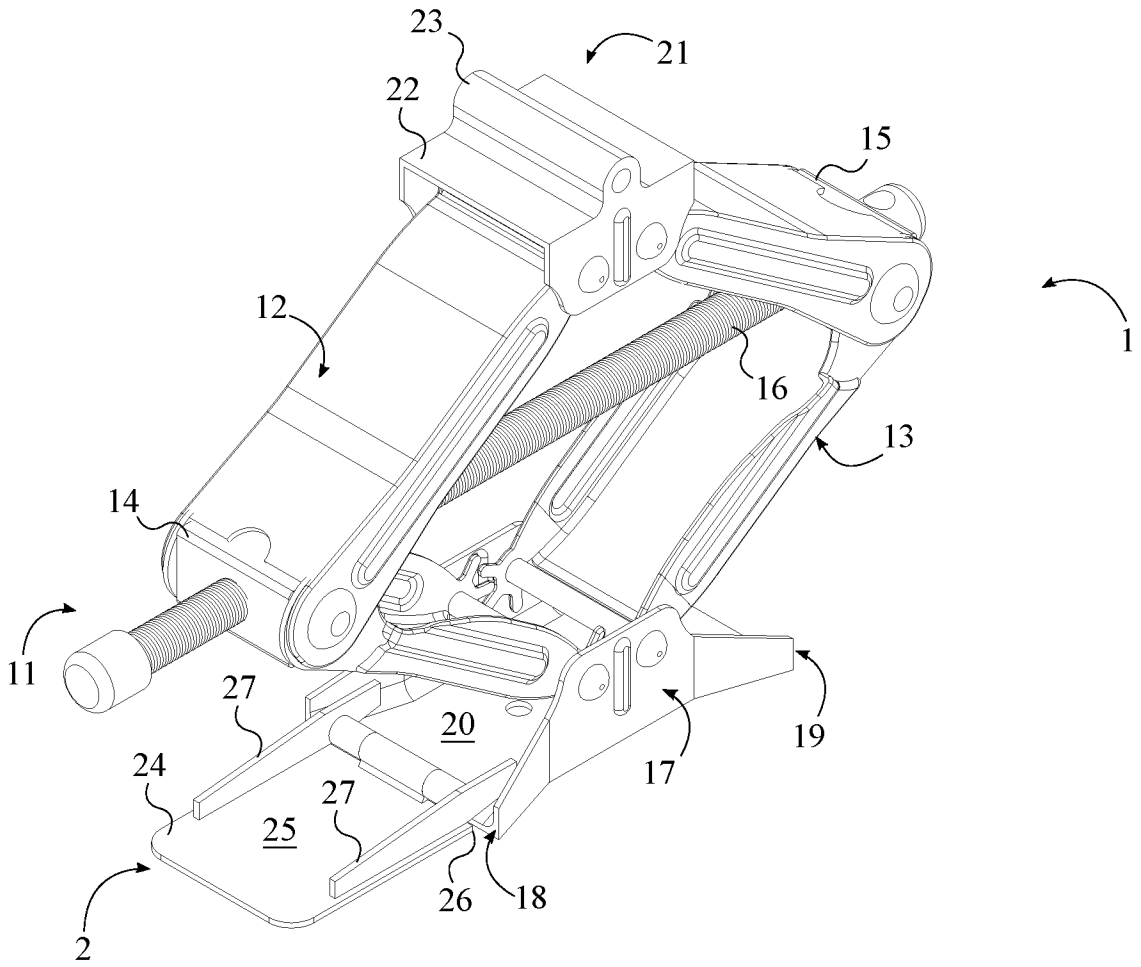
FIG. 3 is a perspective view of the scissor jack and the foot of the present invention.
Figure 4:
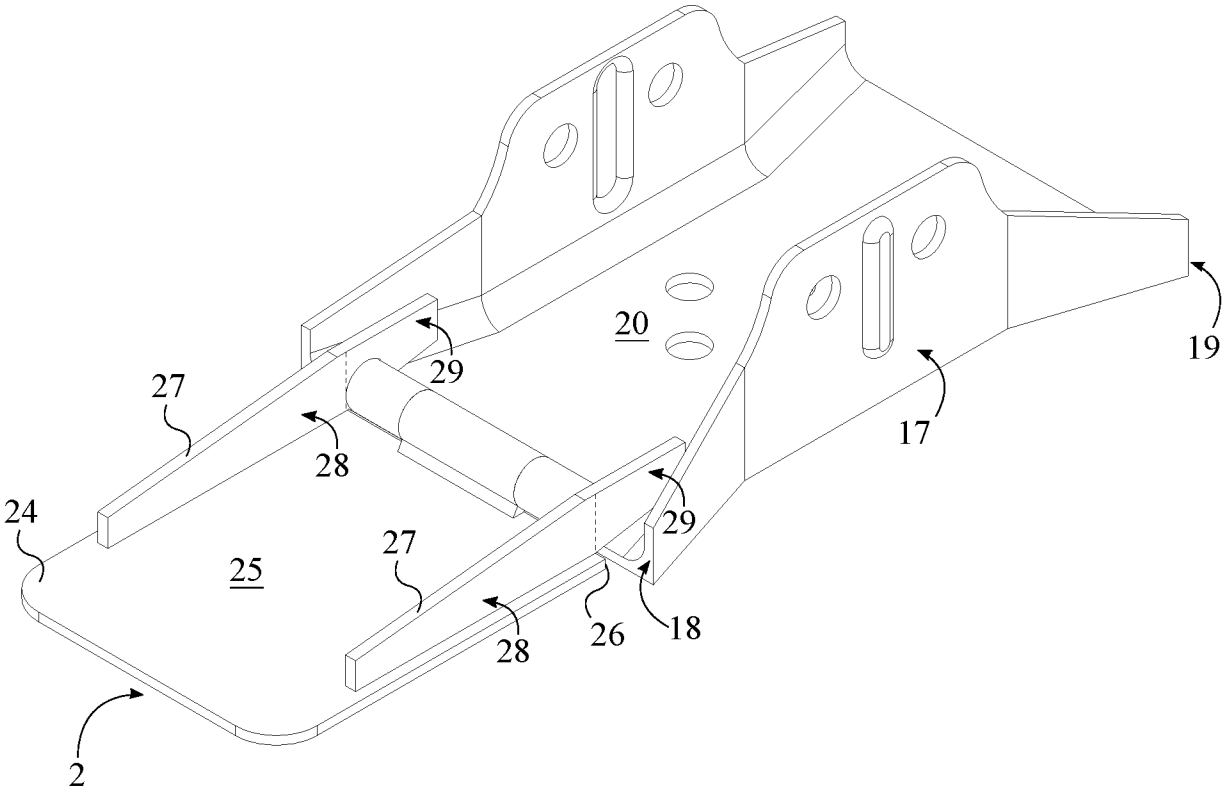
FIG. 4 is a perspective view of the foot and the base pad of the scissor jack of the present invention.

The foot 2 is able to receive some of the motorcycle weight from the base pad 17, during the lifting process of the motorcycle. Once some of the motorcycle weight is transferred to the foot 2, the foot 2 functions as the secondary foundation of the present invention. In reference to FIG. 3-4, the foot 2 comprises a base plate 24, a proximal edge 26, and a pair of stop rails 27. The proximal edge 26 is hingedly connected to the first end 18 of the base pad 17 so that the foot 2 is able to pivot about the proximal edge 26 and the first end 18 of the base pad 17. The hinged connection between the base pad 17 and the foot 2 functions as a lower pivot point within the present invention. The pair of stop rails 27 is perpendicularly connected to a top surface 25 of the base plate 24 to limit the movement of the base pad 17 during the lifting process. More specifically, a first portion 28 of the pair of stop rails 27 is extended along the top surface 25 of the base plate 24 to provide structural connection between the pair of stop rails 27 and the base plate 24. A second portion 29 of the pair of stop rails 27 is extended from the proximal edge 26 to a top surface 20 of the base pad 17. Additionally, the second portion 29 of the pair of stop rails 27 offsets from the top surface 20 of the base pad 17. Due to the positioning of the second portion 29 of the pair of stop rails 27, the base pad 17 can only pivot up to a pre-defined angle once the motorcycle weight is transferred on to the foot 2. As a result, the pair of stop rails 27 prevents the sudden release of the motorcycle weight through the present invention.

The sleeve bracket 21 connects the scissor jack 1 to the mounting adaptor 4 and comprises a U-shaped support 22 and a sleeve housing 23. In reference to FIG. 3, the U-shaped support 22 is mounted to the upper arm assembly 12 to complete the functionality of the scissor jack 1. The sleeve housing 23 is preferably formed into an elongated annular channel to connect with the mounting adaptor 4. The sleeve housing 23 is centrally connected across the U-shaped support 22 and oppositely positioned of the upper arm assembly 12. Additionally, the sleeve housing 23 is positioned perpendicular to the threaded spindle 16, where the movement of the drive trunnion 14 allows the sleeve housing 23 to function as an upper pivot point between the scissor jack 1 and the mounting adaptor 4.

Figure 5:
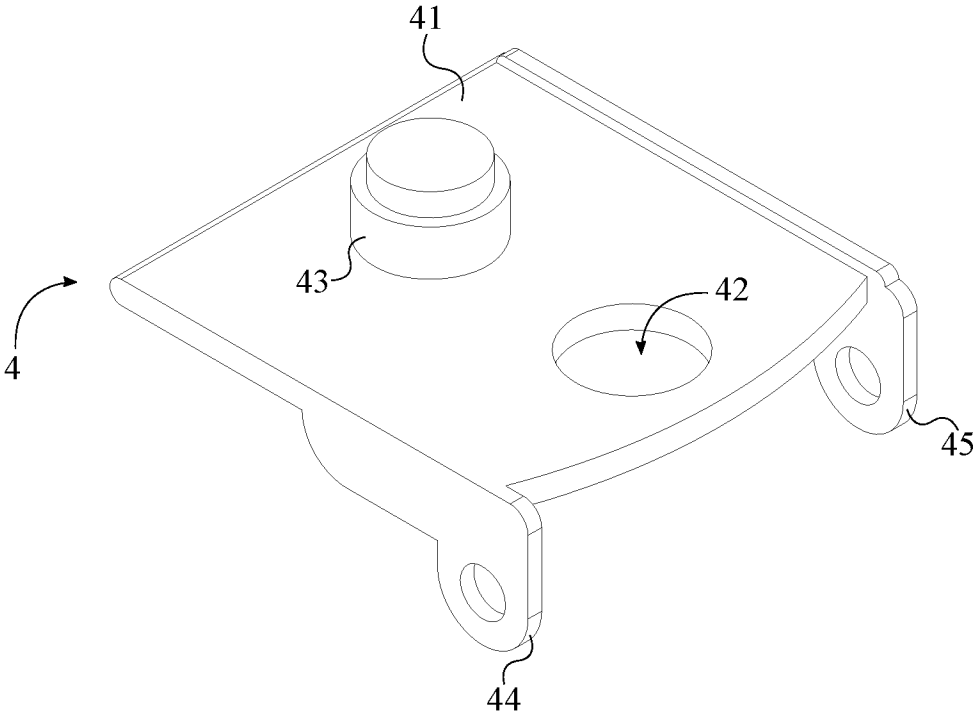
FIG. 5 is a perspective view of the mounting adaptor of the present invention.

The mounting adaptor 4 provides a secure connection between the scissor jack 1 and the motorcycle lift bracket 5. In reference to FIG. 1 and FIG. 5, the mounting adaptor 4 comprises an adaptor plate 41, a bolt hole 42, a dowel 43, a first tab 44, and a second tab 45. The bolt hole 42 is traversed through the adaptor plate 41, wherein the bolt hole 42 functions as an attachment cavity between the mounting adaptor 4 and the motorcycle lift bracket 5. The dowel 43 is adjacently connected to the adaptor plate 41 and oriented parallel to the bolt hole 42. The dowel 43 functions as an alignment member for the mounting adaptor 4 so that the mounting adaptor 4 can be properly aligned with the motorcycle lift bracket 5. The first tab 44 and the second tab 45 is adjacently connected to the adaptor plate 41 to receive the sleeve housing 23 and the fulcrum pin 3. More specifically, the first tab 44 and the second tab 45 are oppositely positioned of each other across the bolt hole 42 to receive the sleeve housing 23. The first tab 44 and the second tab 45 are also extended opposite of the dowel 43, about the adaptor plate 41. As a result, the first tab 44 and the second tab 45 can be easily access by the rider to insert and pivotably attaches the fulcrum pin 3. The first tab 44 and the second tab 45 each comprise a tab-body and a tab-cavity. The tab-body forms the connection of the first tab 44 and the second tab 45 to the adaptor plate 41. The tab-cavity provides an opening for the first tab 44 and the second tab 45 so that the fulcrum pin 3 can be inserted through the tab-cavity of the first tab 44, the sleeve housing 23, and the tab-cavity of the second tab 45. As a result, the upper pivot point can be completed through component configuration of the sleeve housing 23, the fulcrum pin 3, the first tab 44, and the second tab 45.

Figure 6:
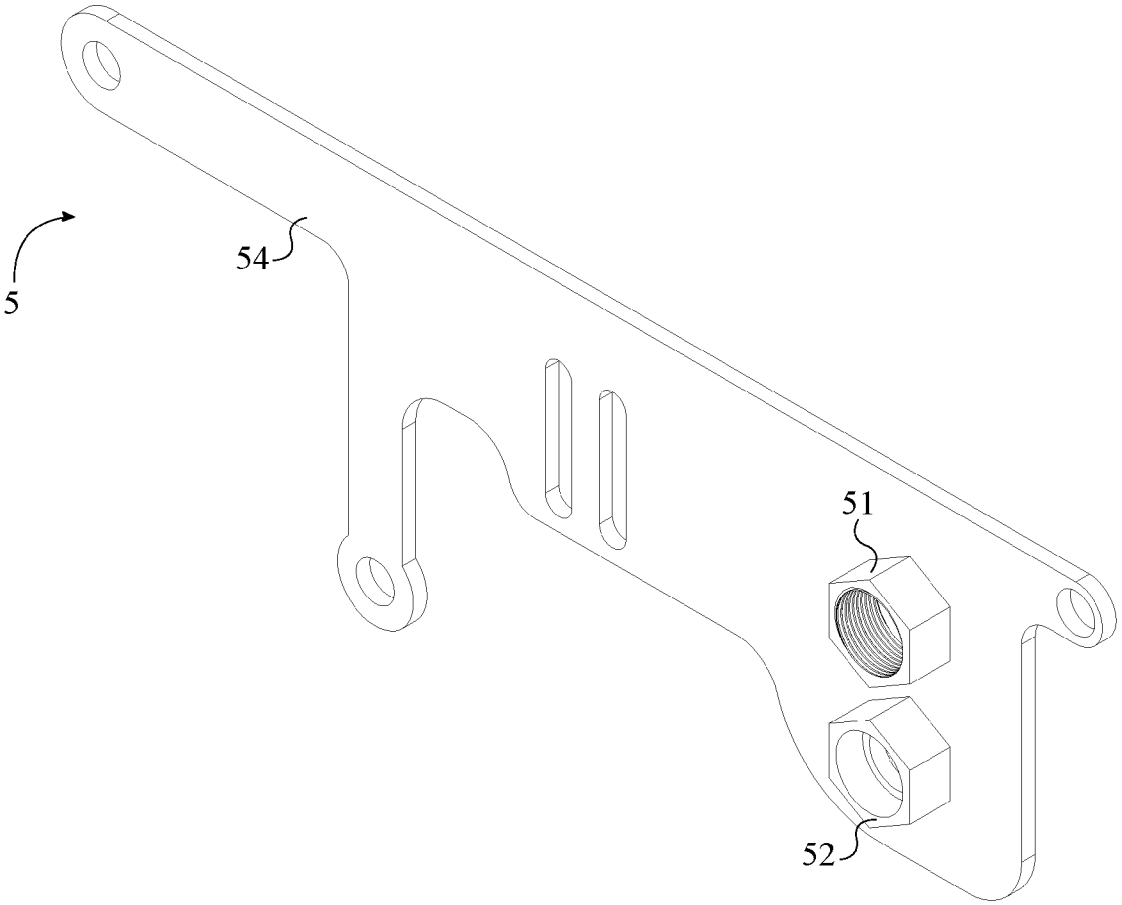
FIG. 6 is a perspective view of the motorcycle lift bracket of the present invention.

The motorcycle lift bracket 5 needs to be retrofitted or premanufactured into the motorcycle so that the scissor jack 1 and the mounting adaptor 4 can be pivotably attached through the fulcrum pin 3. In reference to FIG. 1, FIG. 2, and FIG. 6, the motorcycle lift bracket 5 comprises a body 54, a threaded securing socket 51, and a placement socket 52. The body 54 is secured to the motorcycle through a plurality of fasteners so that the body 54 is able to absorb the motorcycle weight during the lifting process. The threaded securing socket 51 is positioned on the body 54 in such a way that the threaded securing socket 51 is positioned above a center of mass of the motorcycle. The placement socket 52 is positioned on the body 54 and oriented parallel to the treaded securing socket 51. More specifically, the placement socket 52 is vertically positioned below the threaded securing socket 51. As a result of the motorcycle lift bracket 5, the dowel 43 can be concentrically positioned within the placement socket 52 while the bolt hole 42 is concentrically positioned with the threaded securing socket 51. A bolt fastener 53 traverses through the bolt hole 42 and into the threaded securing socket 51 so that the bolt fastener 53 can secure the mounting adaptor 4 to the motorcycle lift bracket 5.

In order to properly secure the present invention to a fallen motorcycle, the rider first needs to locate the threaded securing socket 51 and the placement socket 52 within the motorcycle lift bracket 5. Then, the dowel 43 is placed within the placement socket 52 and the bolt hole 42 is aligned with the securing socket 51 to properly place the mounting adaptor 4 with the motorcycle lift bracket 5. The bolt fastener 53 is then inserted through the bolt hole 42 and finger tightened with the threaded securing socket 51, where the bolt fastener 53 does not require any tools. Additionally, the dowel 43 ensures that the mounting adaptor 4 does not rotate about the bolt hole 42. The scissor jack 1 is then placed underneath the motorcycle, and the sleeve housing 23 is concentrically aligned with the tab-cavity of the first tab 44 and the second tab 45 to insert the fulcrum pin 3. Once the fulcrum pin 3 is inserted within the first tab 44, the sleeve housing 23, and the second tab 45, the present invention can initiate the lifting process of the motorcycle through the threaded spindle 16.

Figure 7:
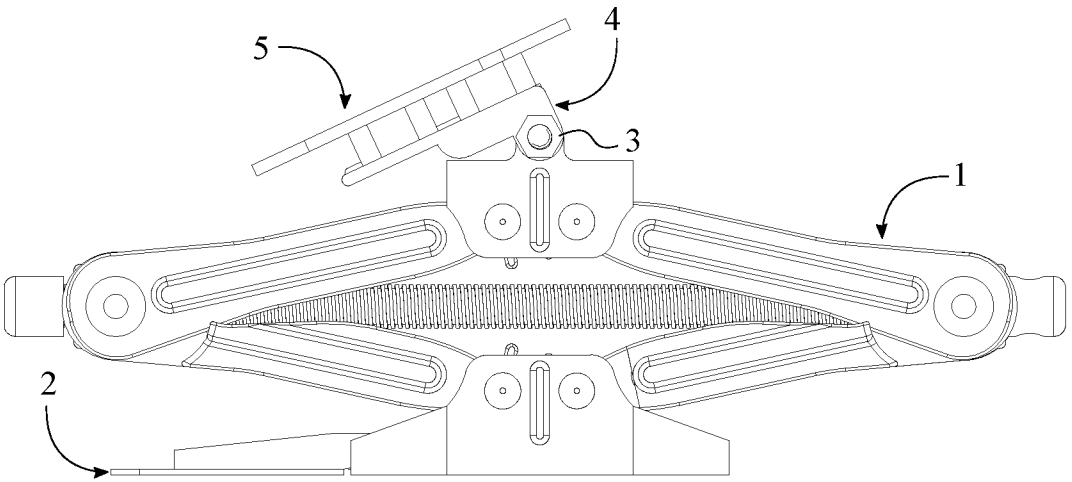
FIG. 7 is a side view of the present invention, illustrating the configuration for the present invention before the initiation of the lifting process.
Figure 8:
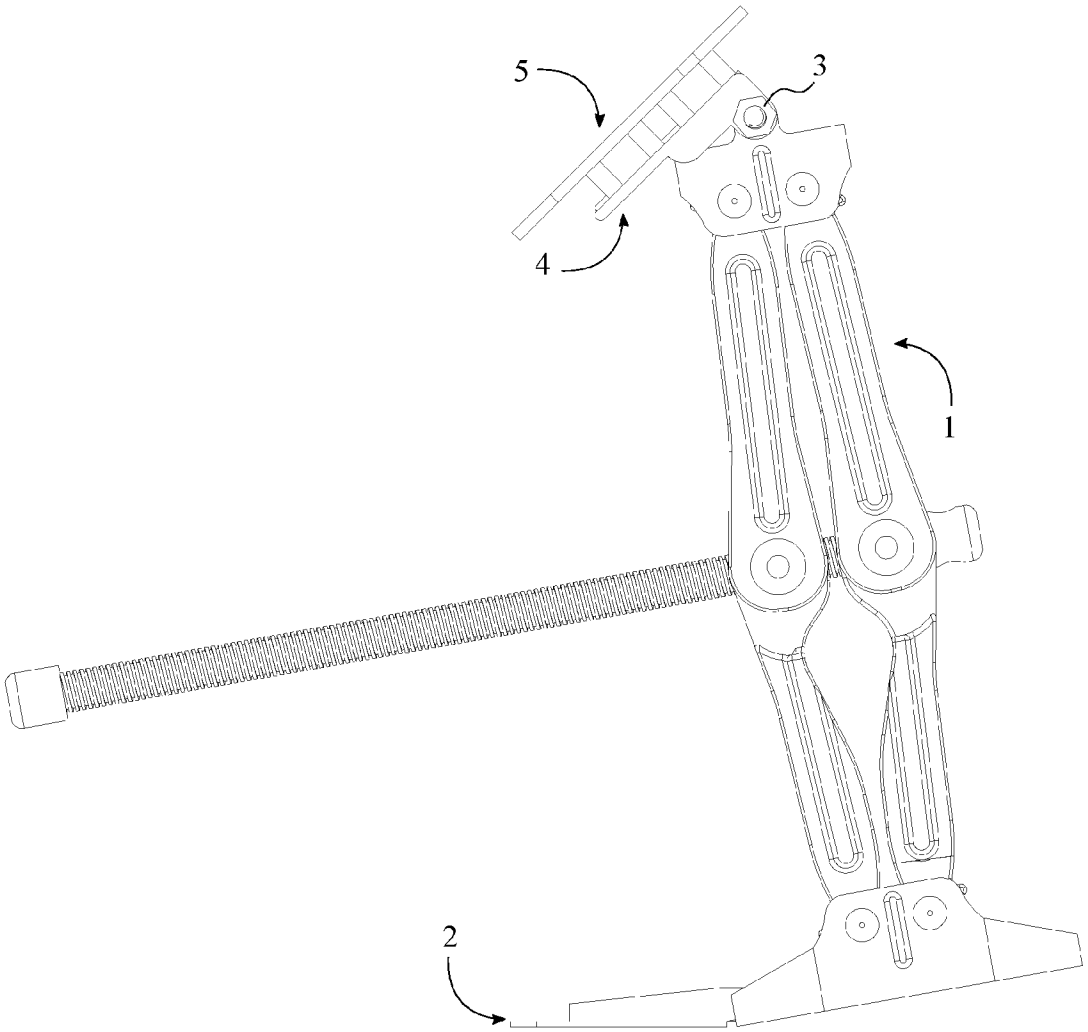
FIG. 8 is a side view of the present invention, illustrating the configuration for the present invention after the initiation of the lifting process.
Figure 9:
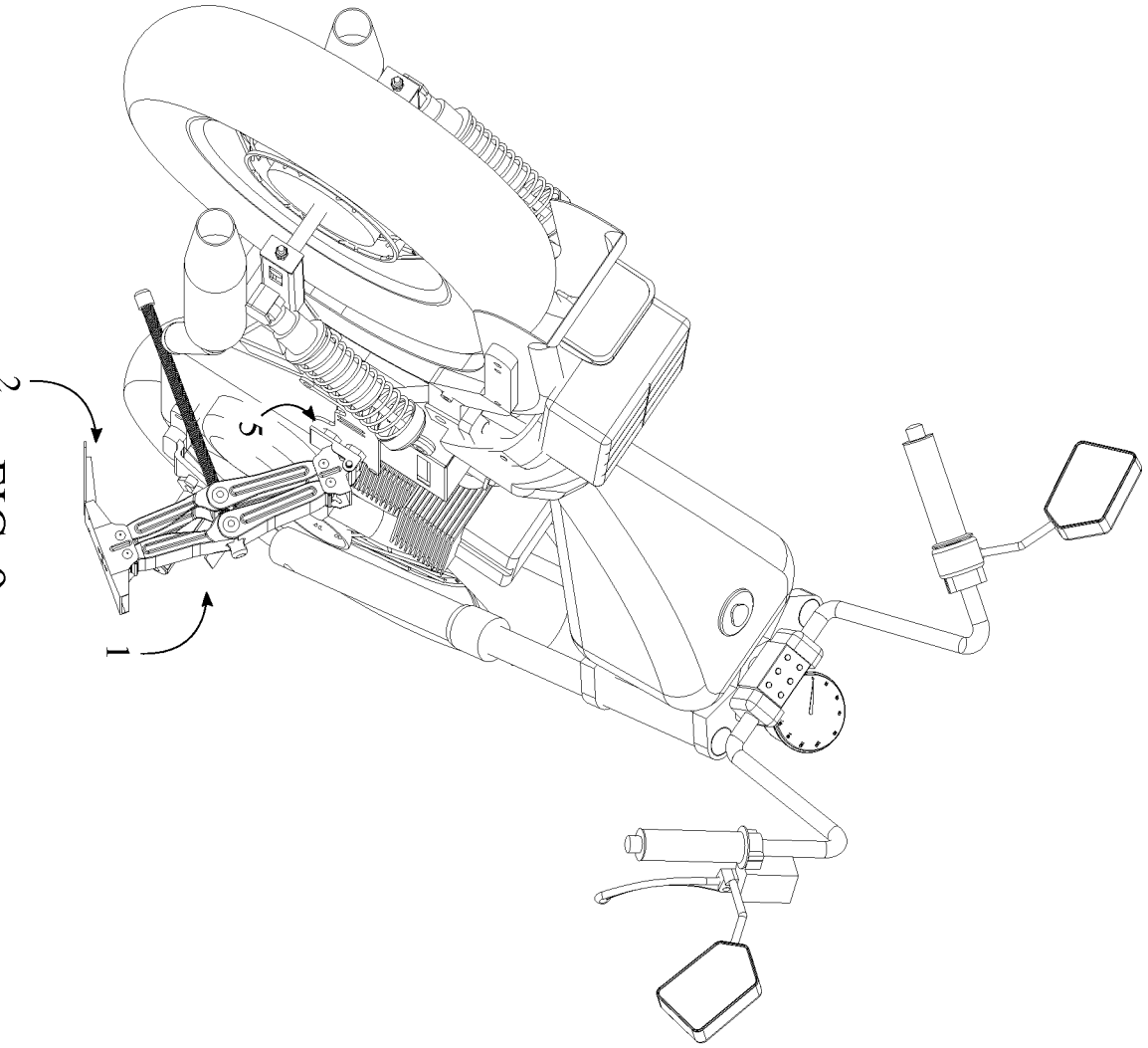
FIG. 9 is a perspective view of the present invention being secured to the motorcycle.

In reference to FIG. 7, FIG. 8, and FIG. 9, the rotation of the threaded spindle 16 pushes the base pad 17 against the ground floor while the sleeve bracket 21 is axially pushes upward from the base pad 17. As a result, the dead weight of the motorcycle is lifted through the present invention. More specifically, the arc length between the start of the lifting process to the 45-degree angle is considered to the most difficult as it represents the dead weight of the motorcycle. However, the present invention absorbs the motorcycle weight by three points and moved through an arc angle from 10-degrees to 70-degrees. Once the motorcycle passes the 45-degree angle, a sufficient amount of the motorcycle weight is transferred to the wheels of the motorcycle. The mounting adaptor 4 and the scissor jack 1 are configured to resist lateral twisting through the lifting process while the mounting adaptor 4 utilizes the upper pivot point. As the motorcycle is lifted through the present invention, the scissor jack 1 tilts the base pad 17 away from the center of mass of the motorcycle such that the base pad 17 utilizes the lower pivot point. Some of the motorcycle weight is then transferred to the foot 2 so that the scissor jack 1 does not slip underneath the motorcycle. In other words, the upper pivot point and the lower pivot point divide the arc angle creates by the lifting process. Once the scissor jack 1 is fully extended through the threaded spindle 16, the rider can gently push the motorcycle back into the upright portion, where push force only requires a fraction of the lift force.

Although the invention has been explained in relation to its preferred embodiment, it is to be understood that many other possible modifications and variations can be made without departing from the spirit and scope of the invention as hereinafter claimed.

What is claimed is:

1. An upstart motorcycle jack system comprises:
a scissor jack;
a foot;
a fulcrum pin;
a mounting adaptor;
the scissor jack comprises a lifting mechanism, a base pad, and a sleeve bracket;
the base pad being mounted to the lifting mechanism;
the sleeve bracket being mounted to the lifting mechanism;
the base pad and the sleeve bracket being oppositely positioned of each other across the lifting mechanism;
the foot being hingedly connected to a first end of the base pad;
the mounting adaptor being removably mounted to a motorcycle lift bracket, wherein the motorcycle lift bracket is integrated onto a motorcycle;
the sleeve bracket being pivotably attached to the mounting adaptor with the fulcrum pin;
the foot comprises a base plate, a proximal edge, and a pair of stop rails;
the proximal edge being hingedly connected to the first end of the base pad;
the pair of stop rails being perpendicularly and adjacently connected to a top surface of the base plate;
a first portion of the pair of stop rails being extended along the top surface of the base plate;
a second portion of the pair of stop rails being extended from the proximal edge to a top surface of the base pad; and
the second portion of the pair of stop rails being offset from the top surface of the base pad.

2. The upstart motorcycle jack system as claimed in claim 1 comprises:
the lifting mechanism comprises an upper arm assembly, a lower arm assembly, a drive trunnion, a stationary trunnion, a threaded spindle;
the base pad being mounted to the lower arm assembly;
the sleeve bracket being mounted to the upper arm assembly;
the lower arm assembly and the upper arm assembly being coaxially mounted to each other by the stationary trunnion and the drive trunnion;
the drive trunnion being adjacently positioned with the first end of the base pad;
the stationary trunnion being adjacently positioned with a second end of the base pad;
the base pad being diametrically opposed of the sleeve bracket; and
the threaded spindle being engaged with the stationary trunnion and the drive trunnion.

3. The upstart motorcycle jack system as claimed in claim 1 comprises:
the sleeve bracket comprises a U-shaped support and a sleeve housing;
the U-shaped support being mounted to an upper arm assembly of the lifting mechanism; and
the sleeve housing being centrally connected across the U-shaped support, opposite the upper arm assembly.

4. The upstart motorcycle jack system as claimed in claim 1 comprises:
a sleeve housing of the sleeve bracket;
the mounting adaptor comprises an adaptor plate, a bolt hole, a dowel, a first tab, and a second tab;
the bolt hole traversing through the adaptor plate;
the dowel being adjacently connected to the adaptor plate;
the dowel being oriented parallel to the bolt hole;
the first tab and the second tab being adjacently connected to the adaptor plate;
the first tab and the second tab being positioned opposite of each across the bolt hole;
the first tab and the second tab being extended opposite of the dowel about the adaptor plate; and
the first tab and the second tab being pivotably attached to the sleeve housing by the fulcrum pin.

5. The upstart motorcycle jack system as claimed in claim 1 comprises:
a bolt hole and a dowel of the mounting adaptor;
the motorcycle lift bracket comprises a body, a threaded securing socket, and a placement socket;
the body being connected to the motorcycle;
the threaded securing socket being positioned on the body;
the placement socket being positioned on the body;
the placement socket being oriented parallel to the treaded securing socket;
the dowel being concentrically positioned within the placement socket;
the bolt hole being concentrically positioned with the threaded securing socket; and
a bolt fastener traversing through the bolt hole and into the threaded securing socket.

6. The upstart motorcycle jack system as claimed in claim 5, wherein the threaded securing socket being positioned above a center of mass of the motorcycle.

7. An upstart motorcycle jack system comprises:
a scissor jack;
a foot;
a fulcrum pin;
a mounting adaptor;
the scissor jack comprises a lifting mechanism, a base pad, and a sleeve bracket;
the foot comprises a base plate, a proximal edge, and a pair of stop rails;
the base pad being mounted to the lifting mechanism;
the sleeve bracket being mounted to the lifting mechanism;
the base pad and the sleeve bracket being oppositely positioned of each other across the lifting mechanism;
the proximal edge hingedly connected to a first end of the base pad;
the pair of stop rails being perpendicularly and adjacently connected to a top surface of the base plate;
the mounting adaptor being removably mounted to a motorcycle lift bracket, wherein the motorcycle lift bracket is integrated onto a motorcycle; and
the sleeve bracket being pivotably attached to the mounting adaptor with the fulcrum pin.

8. The upstart motorcycle jack system as claimed in claim 7 comprises:

the lifting mechanism comprises an upper arm assembly, a lower arm assembly, a drive trunnion, a stationary trunnion, a threaded spindle;

the base pad being mounted to the lower arm assembly;

the sleeve bracket being mounted to the upper arm assembly;

the lower arm assembly and the upper arm assembly being coaxially mounted to each other by the stationary trunnion and the drive trunnion;

the drive trunnion being adjacently positioned with the first end of the base pad;

the stationary trunnion being adjacently positioned with a second end of the base pad;

the base pad being diametrically opposed of the sleeve bracket; and the threaded spindle being engaged with the stationary trunnion and the drive trunnion.

9. The upstart motorcycle jack system as claimed in claim 7 comprises:

a first portion of the pair of stop rails being extended along the top surface of the base plate;

a second portion of the pair of stop rails being extended from the proximal edge to a top surface of the base pad; and the second portion of the pair of stop rails being offset from the top surface of the base pad.

10. The upstart motorcycle jack system as claimed in claim 7 comprises:

the sleeve bracket comprises a U-shaped support and a sleeve housing;

the U-shaped support being mounted to an upper arm assembly of the lifting mechanism; and the sleeve housing being centrally connected across the U-shaped support, opposite the upper arm assembly.

11. The upstart motorcycle jack system as claimed in claim 7 comprises:

a sleeve housing of the sleeve bracket;

the mounting adaptor comprises an adaptor plate, a bolt hole, a dowel, a first tab, and a second tab;

the bolt hole traversing through the adaptor plate;

the dowel being adjacently connected to the adaptor plate;

the dowel being oriented parallel to the bolt hole;

the first tab and the second tab being adjacently connected to the adaptor plate;

the first tab and the second tab being positioned opposite of each across the bolt hole;

the first tab and the second tab being extended opposite of the dowel about the adaptor plate; and the first tab and the second tab being pivotably attached to the sleeve housing by the fulcrum pin.

12. The upstart motorcycle jack system as claimed in claim 7 comprises:

a bolt hole and a dowel of the mounting adaptor;

the motorcycle lift bracket comprises a body, a threaded securing socket, and a placement socket;

the body being connected to the motorcycle;

the threaded securing socket being positioned on the body;

the placement socket being positioned on the body;

the placement socket being oriented parallel to the treaded securing socket;

the dowel being concentrically positioned within the placement socket;

the bolt hole being concentrically positioned with the threaded securing socket; and a bolt fastener traversing through the bolt hole and into the threaded securing socket.

13. The upstart motorcycle jack system as claimed in claim 12, wherein the threaded securing socket being positioned above a center of mass of the motorcycle.

14. An upstart motorcycle jack system comprises:

a scissor jack;

a foot;

a fulcrum pin;

a mounting adaptor;

the scissor jack comprises a lifting mechanism, a base pad, and a sleeve bracket;

the sleeve bracket comprises a U-shaped support and a sleeve housing;

the foot comprises a base plate, a proximal edge, and a pair of stop rails;

the base pad being mounted to a lower arm assembly of the lifting mechanism;

the U-shaped support being mounted to an upper arm assembly of the lifting mechanism;

the sleeve housing being centrally connected across the U-shaped support, opposite the upper arm assembly;

the base pad and the sleeve bracket being oppositely positioned of each other across the lifting mechanism;

the proximal edge hingedly connected to a first end of the base pad;

the pair of stop rails being perpendicularly and adjacently connected to a top surface of the base plate;

the mounting adaptor being removably mounted to a motorcycle lift bracket, wherein the motorcycle lift bracket is integrated onto a motorcycle; and the sleeve bracket being pivotably attached to the mounting adaptor with the fulcrum pin.

15. The upstart motorcycle jack system as claimed in claim 14 comprises:

the lifting mechanism comprises a drive trunnion, a stationary trunnion, a threaded spindle;

the lower arm assembly and the upper arm assembly being coaxially mounted to each other by the stationary trunnion and the drive trunnion;

the drive trunnion being adjacently positioned with the first end of the base pad;

the stationary trunnion being adjacently positioned with a second end of the base pad;

the base pad being diametrically opposed of the sleeve bracket; and the threaded spindle being engaged with the stationary trunnion and the drive trunnion.

16. The upstart motorcycle jack system as claimed in claim 14 comprises:

a first portion of the pair of stop rails being extended along the top surface of the base plate;

a second portion of the pair of stop rails being extended from the proximal edge to a top surface of the base pad; and the second portion of the pair of stop rails being offset from the top surface of the base pad.

17. The upstart motorcycle jack system as claimed in claim 14 comprises:

the mounting adaptor comprises an adaptor plate, a bolt hole, a dowel, a first tab, and a second tab;

the bolt hole traversing through the adaptor plate;

the dowel being adjacently connected to the adaptor plate;

the dowel being oriented parallel to the bolt hole;

the first tab and the second tab being adjacently connected to the adaptor plate;

the first tab and the second tab being positioned opposite of each across the bolt hole;

the first tab and the second tab being extended opposite of the dowel about the adaptor plate; and the first tab and the second tab being pivotably attached to the sleeve housing by the fulcrum pin.

18. The upstart motorcycle jack system as claimed in claim 14 comprises:

a bolt hole and a dowel of the mounting adaptor;

the motorcycle lift bracket comprises a body, a threaded securing socket, and a placement socket;

the body being connected to the motorcycle;

the threaded securing socket being positioned on the body;

the placement socket being positioned on the body;

the placement socket being oriented parallel to the treaded securing socket;

the dowel being concentrically positioned within the placement socket;

the bolt hole being concentrically positioned with the threaded securing socket; and a bolt fastener traversing through the bolt hole and into the threaded securing socket.

19. The upstart motorcycle jack system as claimed in claim 18, wherein the threaded securing socket being positioned above a center of mass of the motorcycle.

* * * * *